US008156592B2

(12) United States Patent
Lee et al.

(10) Patent No.: US 8,156,592 B2
(45) Date of Patent: Apr. 17, 2012

(54) WASHING MACHINE AND METHOD OF CONTROLLING THE SAME

(75) Inventors: Sung Mo Lee, Gunpo-si (KR); Hyun Bae Kim, Yongin-si (KR); Mun Kahp Joe, Suwon-si (KR); Kyo Soon Choi, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 995 days.

(21) Appl. No.: 12/078,941

(22) Filed: Apr. 8, 2008

(65) Prior Publication Data

US 2008/0301884 A1 Dec. 11, 2008

(30) Foreign Application Priority Data

Jun. 5, 2007 (KR) ..... 10-2007-0054985

(51) Int. Cl.
*D06F 33/00* (2006.01)

(52) U.S. Cl. ..... 8/159

(58) Field of Classification Search ..... 8/158–159; 68/12.06, 23.1, 23.2, 23.3
See application file for complete search history.

(56) References Cited

U.S. PATENT DOCUMENTS

| | | | | |
|---|---|---|---|---|
| 6,578,225 | B2 * | 6/2003 | Jonsson | 8/159 |
| 6,647,575 | B2 * | 11/2003 | Garstecki et al. | 8/159 |
| 7,059,002 | B2 * | 6/2006 | Lee et al. | 8/158 |
| 2002/0016997 | A1 * | 2/2002 | Jonsson | 8/159 |
| 2002/0035757 | A1 * | 3/2002 | Ciancimino et al. | 8/159 |
| 2005/0102765 | A1 * | 5/2005 | Jeong et al. | 8/158 |
| 2005/0283918 | A1 * | 12/2005 | Zhang et al. | 8/158 |
| 2005/0283919 | A1 * | 12/2005 | Kim | 8/158 |
| 2006/0000243 | A1 * | 1/2006 | Lee | 68/12.06 |
| 2006/0005319 | A1 * | 1/2006 | Park | 8/158 |

FOREIGN PATENT DOCUMENTS

JP 10-043472 2/1998

* cited by examiner

*Primary Examiner* — Joseph L Perrin
(74) *Attorney, Agent, or Firm* — Staas & Halsey LLP

(57) ABSTRACT

Disclosed herein is a washing machine including a balancer, which increases the speed of a rotation tub stepwise in a period in which an excessive vibration of a water tub occurs to pass the excessive vibration period without the vibration, and a method of controlling the same. The method of controlling the washing machine includes increasing the speed of the rotation tub stepwise in the period in which the excessive vibration of the water tub occurs; measuring current of a motor to detect an amount of unbalance while the speed of the rotation tub is increased stepwise; and controlling the speed of the rotation tub based on the detected amount of unbalance.

5 Claims, 14 Drawing Sheets

FIG. 8

| EXCESSIVE VIBRATION PERIOD | ROTATION SPEED (RPM) |
|---|---|
| ⑤-1 | 160 |
| ⑤-2 | 160 ~ 210 |
| ⑤-3 | 210 |
| ⑤-4 | 210 ~ 260 |
| ⑤-5 | 260 |
| ⑤-6 | 260 ~ 300 |

(A)

(B)

(A)

(B)

WASHING MACHINE AND METHOD OF CONTROLLING THE SAME

CROSS-REFERENCE TO RELATED APPLICATIONS

This application claims the benefit of Korean Patent Application No. 2007-54985, filed on Jun. 5, 2007 in the Korean Intellectual Property Office, the disclosure of which is incorporated herein by reference.

BACKGROUND

1. Field

The present invention relates to a washing machine including a balancer, and more particularly, to a washing machine capable of reducing a vibration of a water tub due to an eccentric state, that is, an unbalance, which may occur at the time of rotation of a rotation tub, and a method of controlling the same.

2. Description of the Related Art

In general, a washing machine (generally, a drum-shaped washing machine) includes a water tub which contains water (washing water or rinsing water) therein, a rotation tub which is rotatably installed in the water tub and contains laundry therein, and a motor which generates a driving force to rotate the rotation tub. The washing machine washes the laundry by an operation of rising and dropping the laundry contained therein along an inner wall of the rotation tub when the cylindrical rotation tub is rotated.

Such a washing machine washes the laundry using a series of operations including a washing mode to wash dirt out of the laundry using water in which a detergent is dissolved (i.e., washing water), a rinsing mode to rinse bubble or residual detergent out of the laundry using water in which the detergent is not dissolved (i.e., rinsing water), and a dehydrating mode to dehydrate the laundry at a high speed. In the dehydrating mode, if the rotation tub is rotated at a high speed in a state in which the laundry is unevenly distributed along an inner wall of the rotation tub and thus an unbalance or imbalance occurs, a force is biased toward a rotation shaft of the rotation tub to generate a large vibration.

In order to prevent the vibration due to such an unbalance, a washing machine including a race which is provided to be concentric with a rotation tub and a balancer having a plurality of balls seated in the race together with oil is disclosed in Japanese Unexamined Patent Application Publication No. 10-43472.

In the washing machine disclosed in the above Publication, when the rotation tub is rotated at a high speed, the balls are automatically moved in the race to prevent the force from being biased toward the rotation shaft such that the unbalance is removed.

However, in the washing machine including the balancer as described above, if the weight of the unbalance is larger than the total weight of the balls, the unbalance cannot be sufficiently removed even if the balls are located opposite the unbalance in the circumferential direction (opposite phase). Thus, the vibration occurs.

If the number of rotations of the rotation tub is less than an inherent number of vibrations of the rotation tub, a difference occurs between a movement speed of the balls and a movement speed of the unbalance (i.e., the rotation speed of the rotation tub), and thus a relative position between the unbalance and the balls periodically varies.

At this time, if the balls and the unbalance are arranged in phase with each other in the circumferential direction (inphase), a larger force is applied to the rotation shaft to generate a larger vibration. If the balls and the unbalance are arranged in phase with each other at a time point when the number of rotations of the rotation tub coincides with the inherent number of vibrations, resonance becomes large enough to generate an excessive vibration of the water tub.

SUMMARY

Therefore, it is an aspect of the embodiment to provide a washing machine including a balancer, which increases a speed of a rotation tub stepwise in a period in which an excessive vibration of a water tub occurs to pass an excessive vibration period without the vibration, and a method of controlling the same.

It is another aspect of the embodiment to provide a washing machine capable of preventing rapid movement of balls to prevent an excessive vibration of a water tub by detecting an unbalance state in real time while a speed of a rotation tub is increased stepwise and by increasing the speed of the rotation tub when the amount of unbalance is less than or equal to a restriction value, and a method of controlling the same.

Additional aspects and/or advantages will be set forth in part in the description which follows and, in part, will be obvious from the description, or may be learned by practice of the invention.

In accordance with the invention, the above and/or other aspects can be achieved by the provision of a method of controlling a washing machine including a water tub, a rotation tub and at least one balancer, the method including: increasing a speed of a rotation tub stepwise in a period in which an excessive vibration of the water tub occurs; measuring current of a motor to detect an amount of unbalance while the speed of the rotation tub is increased stepwise; and controlling the speed of the rotation tub based on the detected amount of unbalance.

The speed of the rotation tub which is increased stepwise may be divided into a plurality of RPM ranges in the period in which the excessive vibration of the water tub occurs, and the speed of the rotation tub may be increased stepwise based on the plurality of RPM ranges.

When the speed of the rotation tub is increased stepwise to reach a predetermined RPM, the speed of the rotation tub may be maintained at the predetermined RPM, and a time in which the speed of the rotation tub is maintained at the predetermined RPM may be counted, and the speed of the rotation tub may be increased after a lapse of a predetermined amount of time.

The predetermined RPM may be the speed of the rotation tub in which an unbalance is able to occur.

The predetermined time may be a reference time necessary to remove the unbalance by the at least one balancer.

The speed of the rotation tub which is increased stepwise may be divided into a plurality of RPM ranges in the period in which the excessive vibration of the water tub occurs, and the speed of the rotation tub may be increased when the amount of unbalance is equal to or less than a predetermined restriction value based on the plurality of RPM ranges.

The rotation tub may be stopped when the amount of unbalance is greater than the restriction value.

The excessive vibration period of the water tub may be approximately 160 to 300 RPM.

The foregoing and/or other aspects are achieved by providing a method of controlling a washing machine including a rotation tub, a motor and at least one balancer, the method including: dividing a speed of the rotation tub stepwise in a predetermined period; increasing the speed of the rotation tub divided stepwise to reach a predetermined RPM and maintaining the speed of the rotation tub at the predetermined RPM, and counting a time in which the speed of the rotation tub is maintained at the predetermined RPM and increasing the speed of the rotation tub after a lapse of a predetermined amount of time.

Current of the motor may be measured to detect an amount of unbalance while the speed of the rotation tub is increased stepwise, and the speed of the rotation tub may be increased when the detected amount of unbalance is equal to or less than a predetermined restriction value.

The rotation tub may be stopped when the amount of unbalance is greater than the restriction value.

The foregoing and/or other aspects are achieved by providing a washing machine including at least one balancer, the washing machine including: a rotation tub to contain laundry therein; a motor rotating the rotation tub; and a control unit driving the motor to increase a speed of the rotation tub stepwise, measuring current of the motor to detect an amount of unbalance while the speed of the rotation tub is increased stepwise, and controlling the speed of the rotation tub based on the detected amount of unbalance.

The control unit may divide the speed of the rotation tub, which is increased stepwise, into a plurality of RPM ranges and increase the speed of the rotation tub stepwise based on the plurality of RPM ranges.

The washing machine may further include a speed detecting unit detecting the speed of the rotation tub which is increased stepwise, and the control unit may control the driving of the motor such that the speed of the rotation tub is maintained at a predetermined RPM when the speed of the rotation tub reaches the predetermined RPM in which an unbalance is able to occur.

The control unit may count a time in which the speed of the rotation tub is maintained at the predetermined RPM and control the driving of the motor such that the speed of the rotation tub is increased after a lapse of a predetermined amount of time.

The control unit may divide the speed of the rotation tub, which is increased stepwise, to a plurality of RPM ranges and control the driving of the motor such that the speed of the rotation tub is increased when an amount of unbalance is equal to or less than a predetermined restriction value based on the plurality of RPM ranges.

The rotation tub may be stopped when the amount of unbalance is greater than the restriction value.

The washing machine may further include a water tub, and the control unit may control the driving of the motor such that the speed of the rotation tub is increased stepwise in a period in which an excessive vibration of the water tub occurs.

The foregoing and/or other aspects are achieved by providing a method of controlling a washing machine including a water tub, a rotation tub and at least one balancer, the method including: detecting an amount of unbalance in an excessive vibration period of the water tub; and increasing a speed of a rotation tub stepwise when the detected amount of unbalance is less than or equal to a restriction value.

The speed of the rotation tub may be divided into a plurality of RPM ranges in the excessive vibration period of the water tub and the speed may be increased stepwise based on the plurality of RPM ranges.

The speed of the rotation tub may be maintained at a first speed within each of the RPM ranges and then increased to a second speed within each of the RPM ranges, the speed of the rotation tub being maintained at the first speed until a time in which the speed of the rotation tub is maintained at the first speed reaches a reference time necessary to remove the unbalance.

BRIEF DESCRIPTION OF THE DRAWINGS

These and/or other aspects and advantages will become apparent and more readily appreciated from the following description of the embodiment, taken in conjunction with the accompanying drawings of which:

FIG. 8 is a table showing an excessive vibration controlling process stepwise in the washing machine including the balancers according to the present embodiment;

DETAILED DESCRIPTION OF THE EMBODIMENTS

Figure 1:
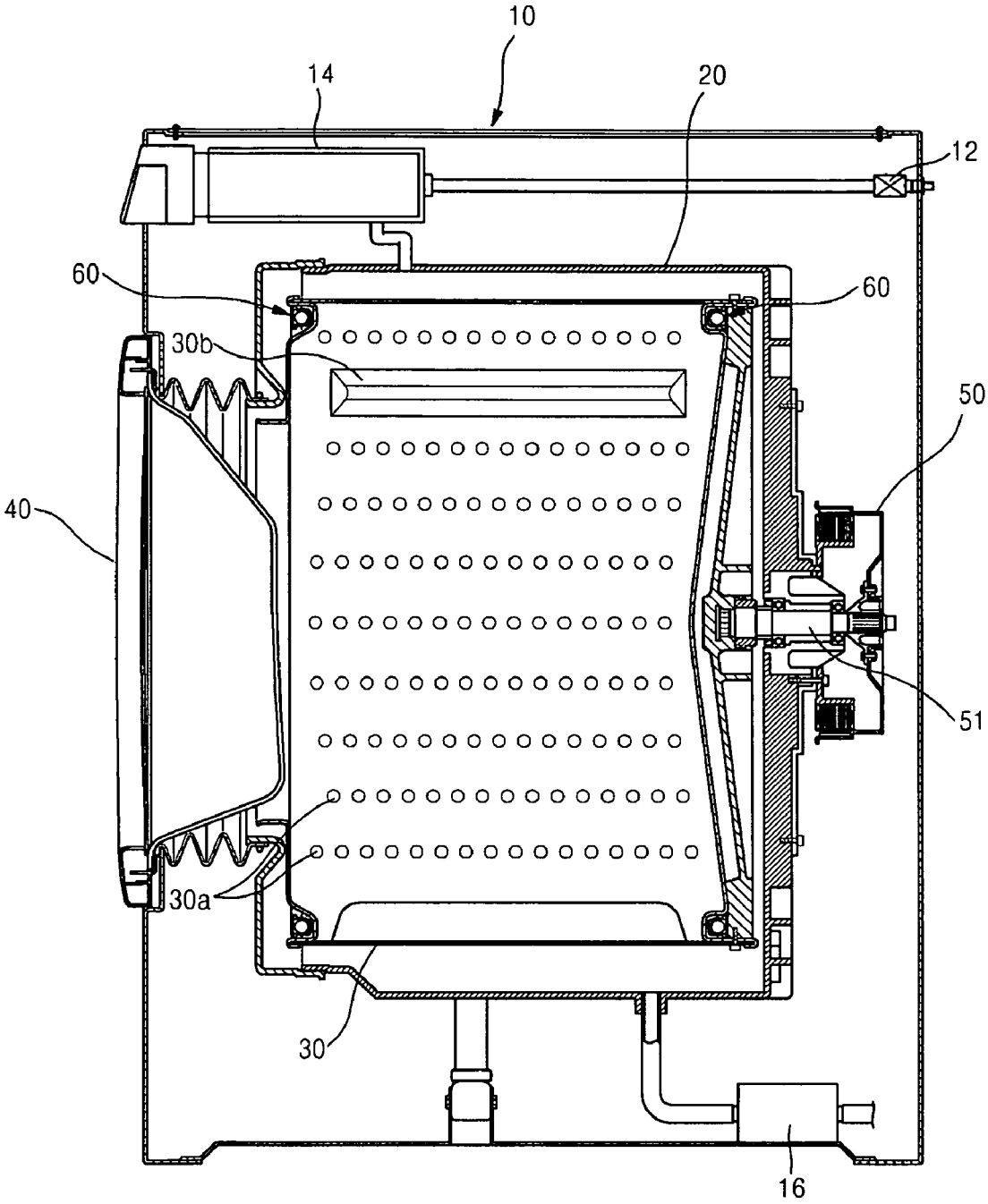
FIG. 1 is a cross-sectional view showing the configuration of a washing machine including balancers according to the present embodiment.

Reference will now be made in detail to the embodiment, examples of which are illustrated in the accompanying drawings, wherein like reference numerals refer to the like elements throughout. The embodiment is described below to explain the present invention by referring to the figures.

FIG. 1 is a cross-sectional view showing the configuration of a washing machine including balancers according to the present embodiment.

In FIG. 1, the washing machine including the balancers according to the present embodiment includes a water tub 20 which is installed in a housing 10 forming an external appearance of the washing machine and contains water therein, a rotation tub 30 which is rotatably installed in the water tub 20 and contains laundry therein, and a door 40 which is hinge-coupled to an open front surface of the housing 10.

A water supplying valve 12 to supply water into the water tub 20 and a detergent supplying device 14 to supply a detergent into the water tub 20 are provided above the water tub 20. A water draining pump 16 to drain water contained in the water tub 20 out of the housing 10 when an operation of washing the laundry is completed is provided below the water tub 20.

A rotation shaft 51 is provided at a side of a rear surface of the rotation tub 30 to penetrate through a rear surface of the water tub 20, and a motor 50 coupled to the rotation shaft 51 is provided outside the rear surface of the water tub 20. Accordingly, when the motor 50 is operated, the rotation shaft 51 is rotated and thus the rotation tub 30 is rotated.

A plurality of dehydration holes 30*a* is formed in a circumferential surface of the rotation tub 30. In a washing mode, water which is contained in the water tub 20 flows into the rotation tub 30 through the dehydration holes such that the laundry is washed by water containing a detergent therein. In a dehydrating mode, water is drained from the housing 10 through the water draining pump 16.

A plurality of lifters 30*b* is provided in the rotation tub 30 in a vertical direction such that wet laundry is lifted up from a bottom of the rotation tub 30 and is lifted down to the bottom of the rotation tub 30 when the rotation tub 30 is rotated at a low speed in the washing mode. Thus, the laundry can be efficiently washed.

Accordingly, in the washing mode, the rotation tub 30 is rotated at a low speed while the rotation shaft 51 is alternately rotated forward and backward by the motor 50, such that the laundry is washed. In the dehydrating mode, the rotation tub 30 is rotated at a high speed while the rotation shaft 51 is rotated in one direction, so that the laundry is dehydrated.

When the rotation tub 30 is rotated at the high speed in the dehydrating mode, if the center of gravity of the rotation tub 30 does not coincide with the center of rotation or the laundry is unevenly distributed in the rotation tub 30 such that an unbalance occurs in a specific portion, a force is biased toward the rotation shaft 51 of the rotation tub 30 and thus a dynamic balance of the rotation tub 30 is not maintained.

In order to prevent a dynamic unbalance such that the rotation tub 30 can be rotated at the high speed in a state in which the center of gravity of rotation tub 30 coincides with the center of rotation, balancers 60 are provided at a front end and a rear end of the rotation tub 30.

Figure 2:
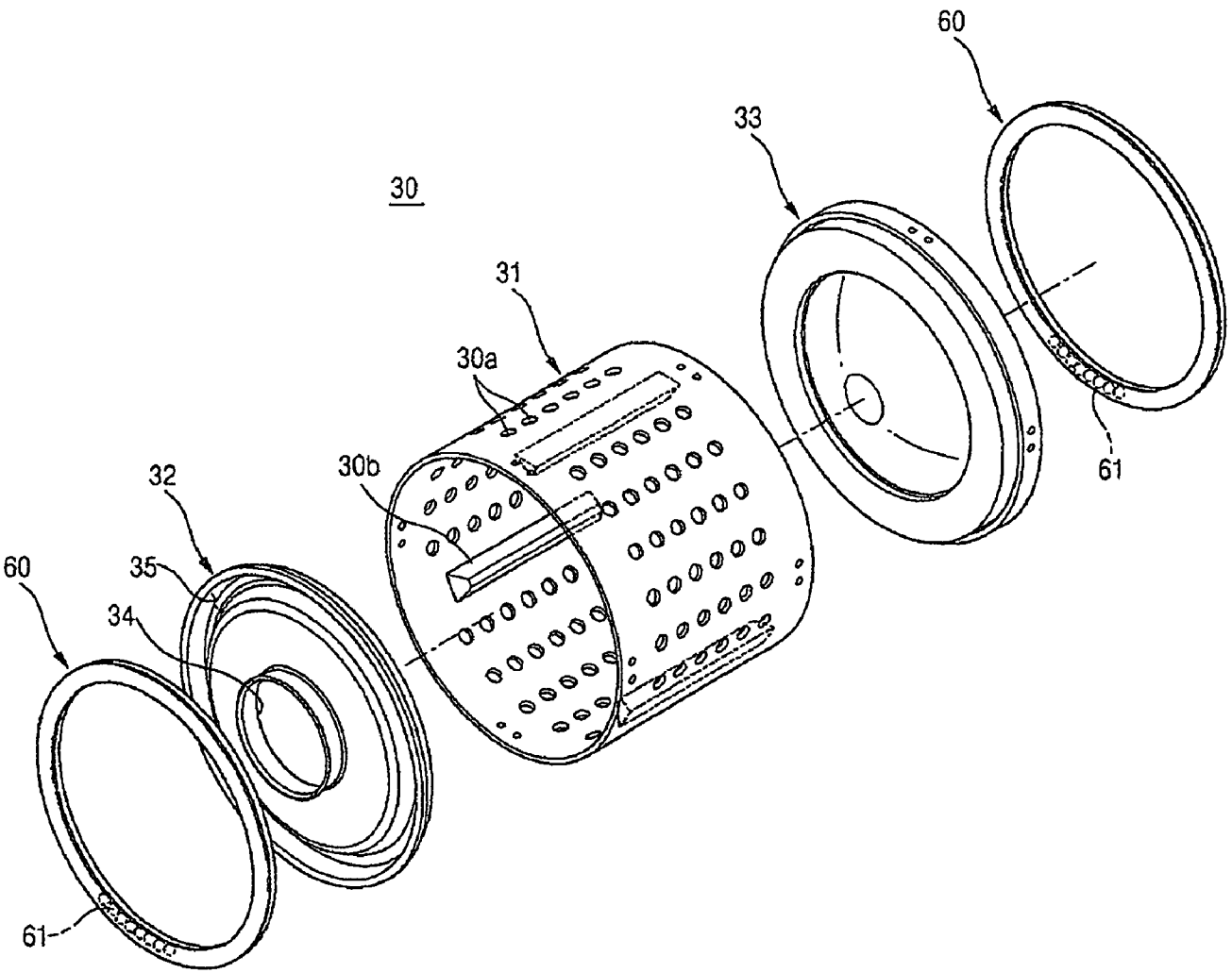
FIG. 2 is an exploded perspective view of a rotation tub according to the present embodiment.
Figure 3:
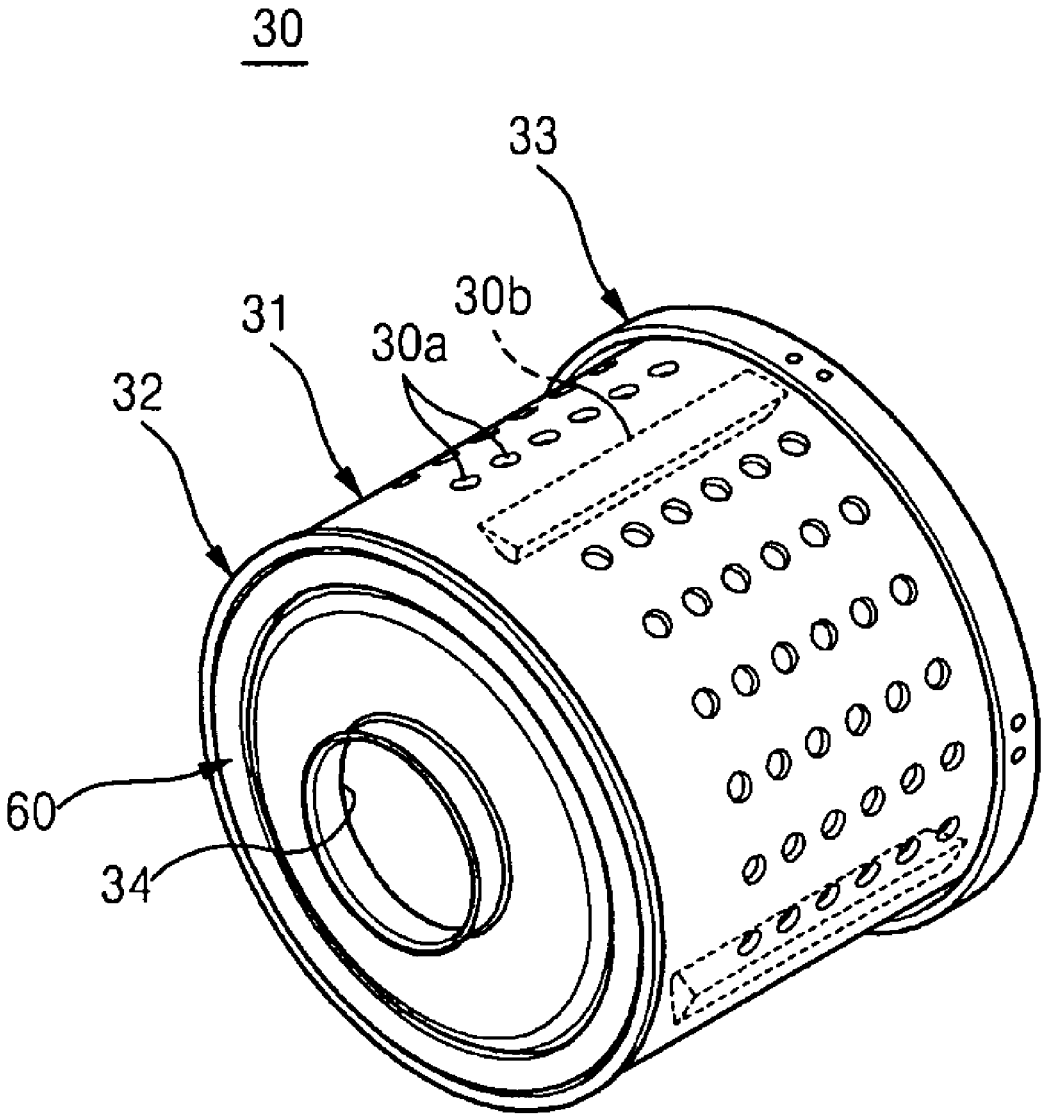
FIG. 3 is a coupled perspective view of the rotation tub according to the present embodiment.

FIG. 2 is an exploded perspective view of the rotation tub according to the present embodiment, and FIG. 3 is a coupled perspective view of the rotation tub according to the present embodiment.

In FIG. 2, a front surface and a rear surface of the rotation tub 30 are opened. The rotation tub 30 includes a cylindrical main body 31 including the dehydration holes 30*a* and the lifters 30*b*, a front side member 32 which is coupled to the opened front surface of the main body 31 and has an opening 34 through which the laundry is put into the main body 31 and is taken out from the main body 31, and a rear side member 33 which is coupled to the opened rear surface of the main body 31 and receives the rotation shaft 51 to rotate the rotation tub 30.

An annular recess 35 which has a substantially U-shape in a cross section and is opened toward a front side of the washing machine is formed in the circumference of the front side member 32 to contain a balancer 60 therein. An annular recess (not shown) which is opened toward a rear side of the washing machine is formed in the circumference of the rear side member 33 to contain another balancer 60 therein.

The front side member 32 and the rear side member 33 are respectively fitted into the front circumference and the rear circumference of the main body 31 by a screwing method or other fixing method, as shown in FIG. 3.

The balancers 60 are mounted in the recesses 35 of the front side member 32 and the rear side member 33. Each of the balancers 60 is an annular single race and includes a plurality of balls 61 which is made of steel, for example, and has a balancing function and viscous fluid (not shown) to adjust the movement speed of the plurality of balls 61.

The balls 61 are mounted to be moved in a circumferential direction. When the dynamic unbalance occurs in the rotation tub 30, the balls 61 are moved in the circumferential direction to a position which is symmetrical to a position at which the dynamic unbalance occurs. Thus, the vibration of the rotation tub 30 can be reduced.

Figure 4:
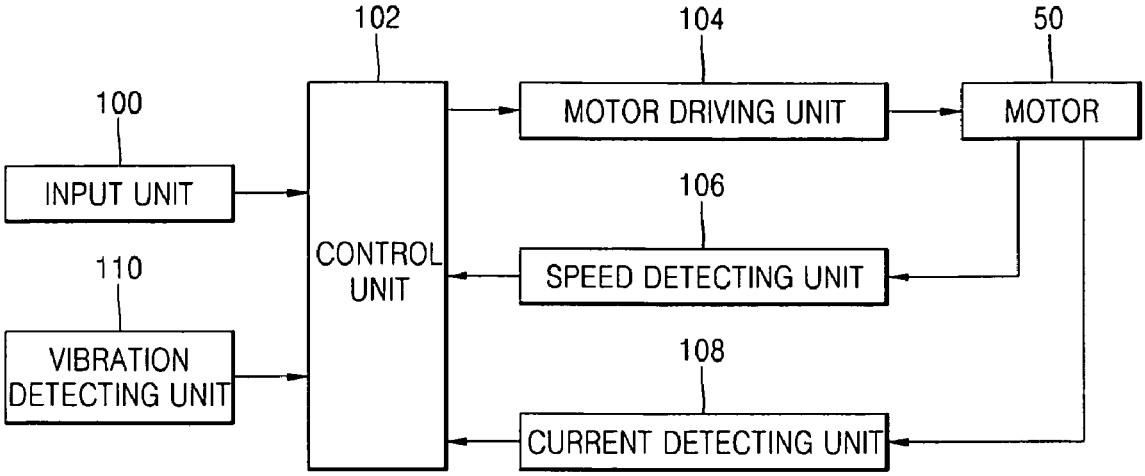
FIG. 4 is a block diagram showing a control configuration of the washing machine including the balancers according to the present embodiment.

FIG. 4 is a block diagram showing the control configuration of the washing machine including the balancers according to the present embodiment.

In FIG. 4, the washing machine according to the present embodiment includes an input unit 100 to allow a user to input an operation command including the setting of the dehydrating mode, a control unit 102 controlling the whole operation of the washing machine such as a washing mode, a rinsing mode and a dehydrating mode, a motor driving unit 104 driving the motor 50 to rotate the rotation tub 30 under the control of the control unit 102, a speed detecting unit 106 to send a motor speed signal corresponding to the rotation speed of the rotation tub 30 to the control unit 102, and a current detecting unit 108 to send a motor current signal corresponding to the rotation speed of the rotation tub 30 to the control unit 102.

The washing machine according to the present embodiment further includes a vibration detecting unit 110 to detect the vibration in X and Y axes. The vibration detecting unit 110 detects the vibration of the water tub 20 which is generated before the balls 61 reach a balancing position in the washing machine including the balancers 60, thereby obtaining a signal waveform of a vibration frequency shown in FIG. 5.

Figure 5:
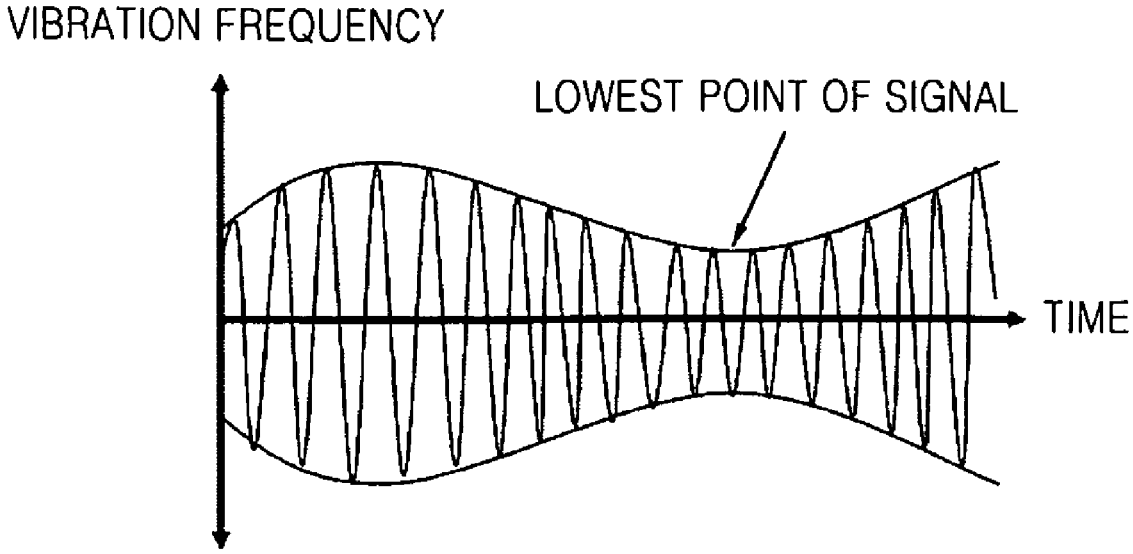
FIG. 5 is a waveform diagram showing a generation of a vibration of a water tub due to a difference in rotation speed between the rotation tub and balls in the washing machine including the balancers according to the present embodiment.
Figure 6:
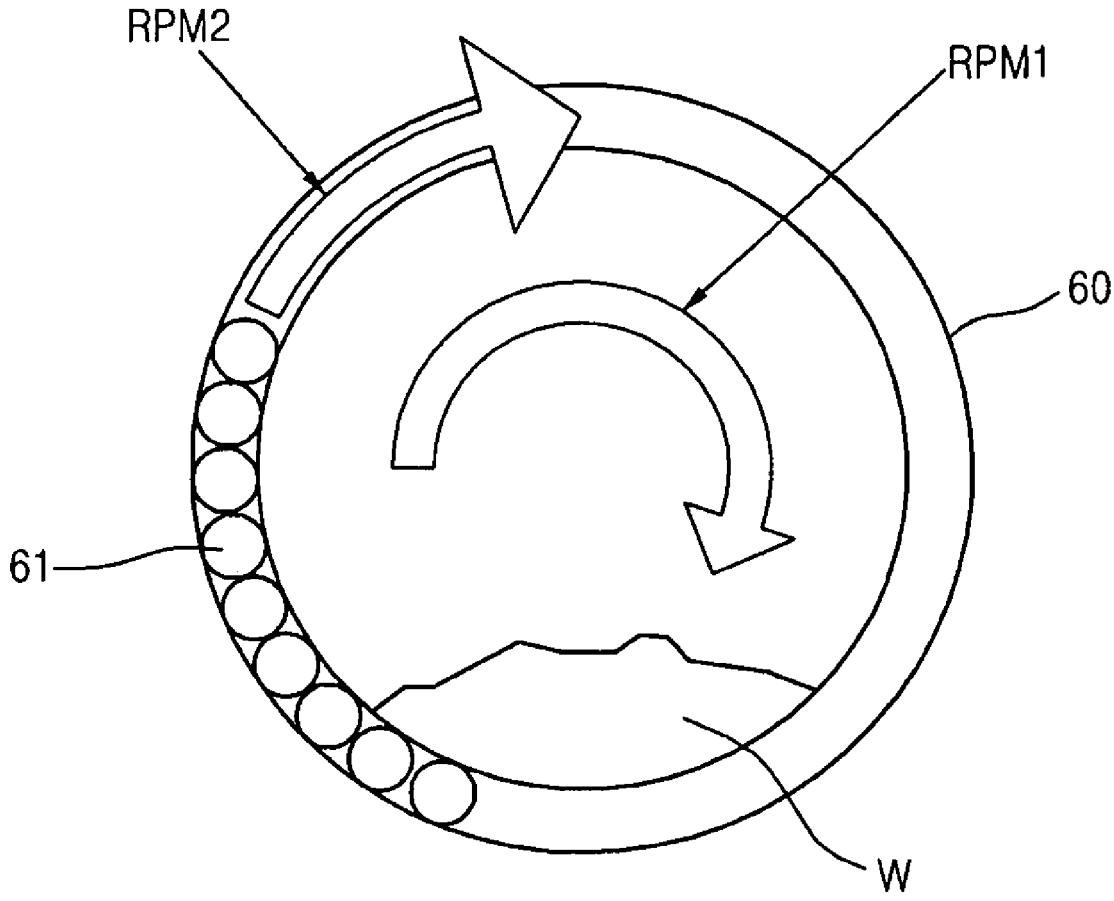
FIG. 6 is a view showing a difference in rotation speed between the rotation tub and the balls in the washing machine including the balancers according to the present embodiment.

FIG. 5 shows a signal waveform of the vibration frequency which is generated due to a modulation phenomenon due to a difference between the rotation speed (RPM1) of the rotation tub 30 and the rotation speed (RPM2) of the balls 61 shown in FIG. 6.

Figure 7:
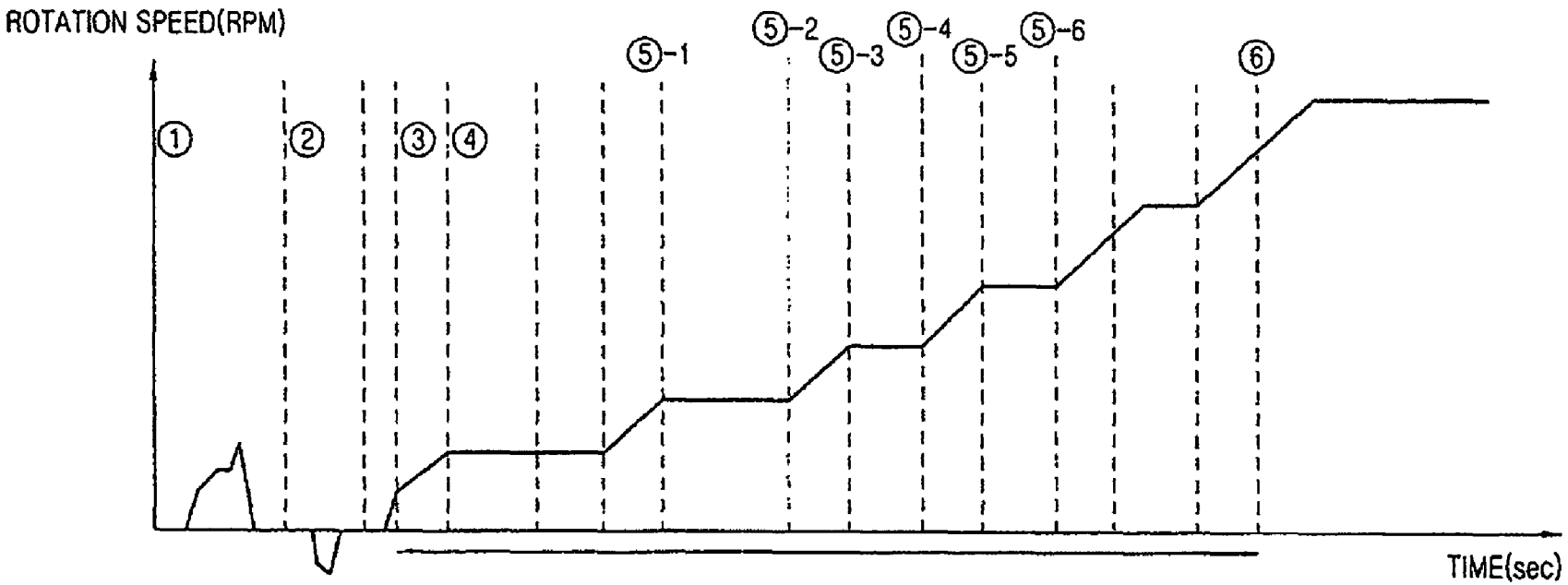
FIG. 7 is a graph showing a speed profile in a dehydrating mode of the washing machine including the balancers according to an embodiment of the present embodiment.

The control unit 102 performs the dehydrating mode with a speed profile shown in FIG. 7 in order to dehydrate the laundry at a high speed without an excessive vibration of the water tub 20.

FIG. 7 is a graph showing a speed profile of the washing machine including the balancers 60 according to the present embodiment at the time of the dehydrating mode.

In FIG. 7, the dehydrating mode includes a laundry amount detecting process 1 of detecting the weight of the laundry at the time of starting of the dehydrating mode, a laundry disentangling process 2 of reversing the left and the right of the rotation tub 30 to disentangle the laundry, a laundry rolling process 3 of increasing the speed of the rotation tub 30 at a predetermined speed to stick the laundry to the inner wall of the rotation tub 30, an unbalance detecting process 4 of detecting the amount of unbalance using a control parameter such as the weight of the laundry and the current of the motor 50, an excessive vibration controlling process 5 of increasing the speed of the rotation tub 30 stepwise when the amount of unbalance detected in an excessive vibration period of the water tub 20 is less than a restriction value, and a high-speed dehydrating process 6 rotating the rotation tub 30 at a high speed and draining water contained in the laundry by a centrifugal force after increasing the speed of the rotation tub 30 stepwise and passing the excessive vibration period of the water tub 20 without the vibration.

The excessive vibration period of the water tub 20 indicates a period in which the speed of the rotation tub 30 is 160 to 300 RPM, for example. When the speed of the rotation tub 30 is in a range from 160 to 300 RPM, a mechanical resonance point exists and a large amount of water contained in the laundry is drained. Thus, the unbalance may occur. In addition, a phenomenon that the balls 61 are dispersed also occurs and a probability that the excessive vibration of the water tub 20 occurs is high. However, it is difficult to expect the phenomenon and the probability.

Accordingly, in the excessive vibration controlling process 5 of the present embodiment, the speed of the rotation tub 30 is not increased at once in the excessive vibration period of 160 to 300 RPM. That is, as shown in FIG. 8, the excessive vibration controlling process 5 includes a first step 5-1 of maintaining a start point, that is, 160 RPM, of the excessive vibration period when the speed of the rotation tub 30 is increased after detecting the unbalance, a second step 5-2 of increasing the speed from 160 RPM to 210 RPM, a third step 5-3 of maintaining the speed of 210 RPM for approximately 10 seconds to prevent the balls 61 from being rapidly moved and positioned opposite the unbalance of the rotation tub 30, a fourth step 5-4 of increasing the speed from 210 RPM to 260 RPM, a fifth step 5-5 of maintaining the speed of 260 RPM for approximately 10 seconds to prevent the balls from being rapidly moved and positioned opposite the unbalance of the rotation tub 30, and a sixth step of 5-6 of increasing the speed from 260 RPM to 300 RPM, thereby increasing the speed of the rotation tub 30 stepwise such that the amount of unbalance is not rapidly changed. While the speed of the rotation tub 30 is increased stepwise, the amount of unbalance is detected in real time. If the amount of unbalance is less than or equal to a restriction limit, the speed of the rotation tub 30 is increased by the six steps such that the rapid movement of the balls 61 is prevented to pass the excessive vibration period of the water tub 20 without the vibration.

In the excessive vibration controlling process 5 of the present embodiment, the amount of unbalance is always detected in real time and the rotation tub 30 is stopped when the amount of unbalance is greater than the restriction value.

Hereinafter, the operation and effect of the washing machine and the method of controlling the same will be described.

Figure 9:
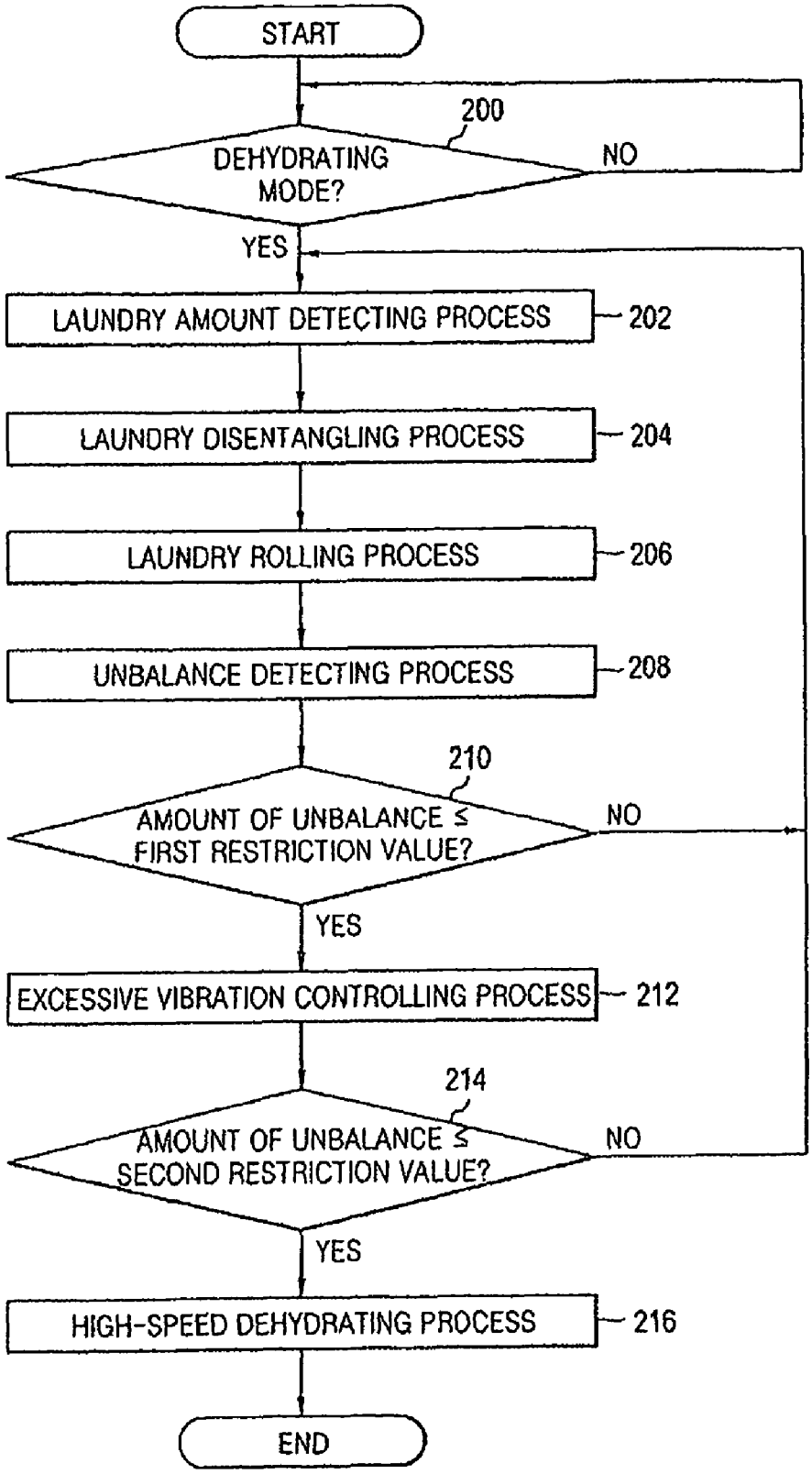
FIG. 9 is a flowchart illustrating the excessive vibration controlling process of the washing machine including the balancers according to the present embodiment.

FIG. 9 is a flowchart illustrating the excessive vibration controlling process of the washing machine including the balancers according to the present embodiment, that is, a method of dehydrating the laundry at a high speed while passing an excessive vibration period of the water tub 20 without the vibration in the dehydrating mode.

When a user puts the laundry W into the rotation tub 30 and inputs an operation command including the setting of the dehydrating mode through the input unit 100, the control unit 102 performs the series of operations including the washing mode, the rinsing mode and the dehydrating mode.

Accordingly, the control unit 102 determines whether the mode becomes the dehydrating mode (200). If it is determined that the mode becomes the dehydrating mode, the laundry amount detecting process 1 of detecting the weight of the laundry W is performed as shown in FIG. 7 (202), in order to use the weight of the laundry W as basic information to detect the amount of unbalance or determine an allowable amount of unbalance before the high-speed dehydrating process.

After the laundry amount detecting process 1, the control unit 102 performs the laundry disentangling process 2 of controlling the driving of the motor 50 through the motor driving unit 104 and reversing to the left and the right of the rotation tub 30 to disentangle the laundry W as shown in FIG. 7 (204).

After the laundry disentangling process 2, the control unit 102 performs the laundry rolling process 3 of increasing the speed of the rotation tub 30 to the predetermined speed and sticking the laundry W to the inner wall of the rotation tub 30 as shown in FIG. 7 (206).

After the laundry rolling process 3, the control unit 102 performs the unbalance detecting process 4 of detecting the amount of unbalance using the control parameter such as the weight of the laundry W and the current of the motor 50 as shown in FIG. 7 (208).

The processes from the laundry amount detecting process 1 to the unbalance detecting process 4 correspond to a general process of reducing the unbalance in order to make the balance of the laundry W uniform before the high-speed dehydrating process of the washing machine and thus the detailed description thereof will be omitted.

Thereafter, the control unit 102 determines whether the amount of unbalance detected in the unbalance detecting process 4 is equal to or less than a predetermined first restriction value (210). If it is determined that the detected amount of unbalance is greater than the first restriction value, the rotation tub 30 is stopped and the process returns to operation 202.

If the detected amount of unbalance is equal to or less than the first restriction value in operation 210, the excessive vibration controlling process 5 of increasing the speed of the rotation tub 30 stepwise to pass the excessive vibration period of the water tub 20 without the vibration is performed as shown in FIGS. 7 and 8 (212).

Since the mechanical resonance point exists and a large amount of water contained in the laundry W is drained in the excessive vibration period of 160 to 300 RPM, a probability that the unbalance occurs is high. Accordingly, as shown in FIG. 8, in the excessive vibration controlling process 5 of the present embodiment, the speed of the rotation tub 30 is not increased at once. That is, the speed of the rotation tub 30 is increased stepwise by the first step 5-1 to the sixth step 5-6 such that the amount of unbalance is not rapidly changed. Thus, the balls 61 are prevented from being rapidly moved to pass the excessive vibration period of the water tub 20 without the vibration.

During the excessive vibration controlling process 5 of increasing the speed of the rotation tub 30 stepwise, the amount of unbalance is always detected in real time and it is determined whether the amount of unbalance is equal to or less than a predetermined second restriction value (214). It is determined that the amount of unbalance is greater than the second restriction value, the rotation tub 30 is stopped and the process returns to operation 202.

If the detected amount of unbalance is equal to or less than the second restriction value in operation 214, the high speed dehydrating process 6 of rotating the rotation tub 30 at a high speed and draining water contained in the laundry by a centrifugal force after increasing the speed of the rotation tub 30 stepwise and passing the excessive vibration period of the water tub 20 without the vibration is performed as shown in FIGS. 7 and 8 (216).

The first restriction value and the second restriction value to determine the unbalance state of the laundry W are different from each other. The restriction values to determine the unbalance state in the processes 3 to 6 are different from each other because the unbalance degrees of the processes 3 to 6 which are performed according to the speed profile shown in FIG. 7 are different from one another.

The present embodiment will now be described in detail with reference to FIG. 10.

Figure 10:
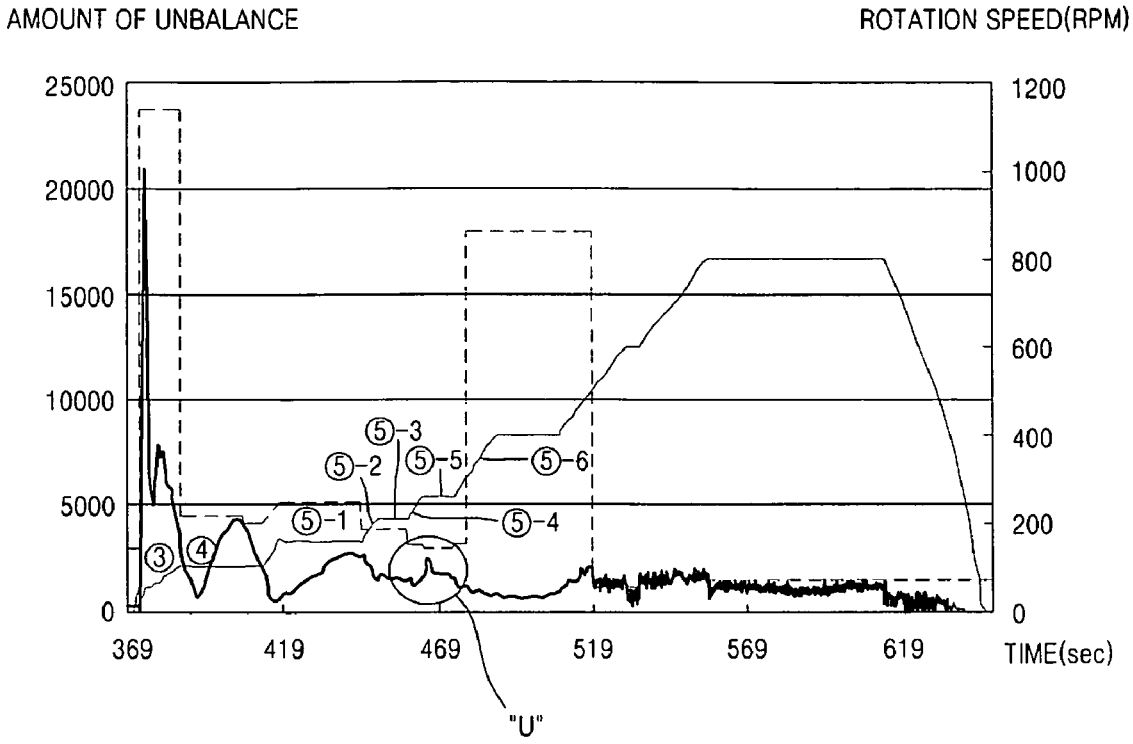
FIG. 10 is a graph showing a relationship between the amount of unbalance and a speed in the excessive vibration controlling process of the washing machine including the balancers according to the present embodiment.

FIG. 10 is a graph showing a relationship between the amount of unbalance and the speed when the excessive vibration controlling process 5 is performed in the washing machine including the balancers according to the present embodiment.

In FIG. 10, a thin solid line represents the rotation speed (RPM) of the rotation tub 30 which is increased stepwise according to the speed profile shown in FIG. 7, a thick solid line represents an actual amount of unbalance which occurs while the speed of the rotation tub 30 is increased stepwise according to the speed profile shown in FIG. 7, and a dotted line represents an unbalance restriction value to determine the unbalance state while the speed of the rotation tub 30 is increased stepwise according to the speed profile shown in FIG. 7.

As shown in FIG. 10, the unbalance restriction values of the processes are set to be different from one another. If the speed of the rotation tub 30 is increased stepwise in the excessive vibration period of the water tub 20 of 160 RPM to 300 RPM, the amount of unbalance is increased and is then decreased as denoted by a circle of "U". This is because a time to remove a new unbalance is allowed if a predetermined rotation speed (RPM) is maintained.

In the washing machine including the balancers according to the present embodiment, the speed of the rotation tub 30 is increased stepwise in the period (about 160 to 300 RPM) in which the excessive vibration of the water tub 20 occurs, such that the balls 61 are prevented from being rapidly moved to pass the excessive vibration period of the water tub 20.

Figure 11:
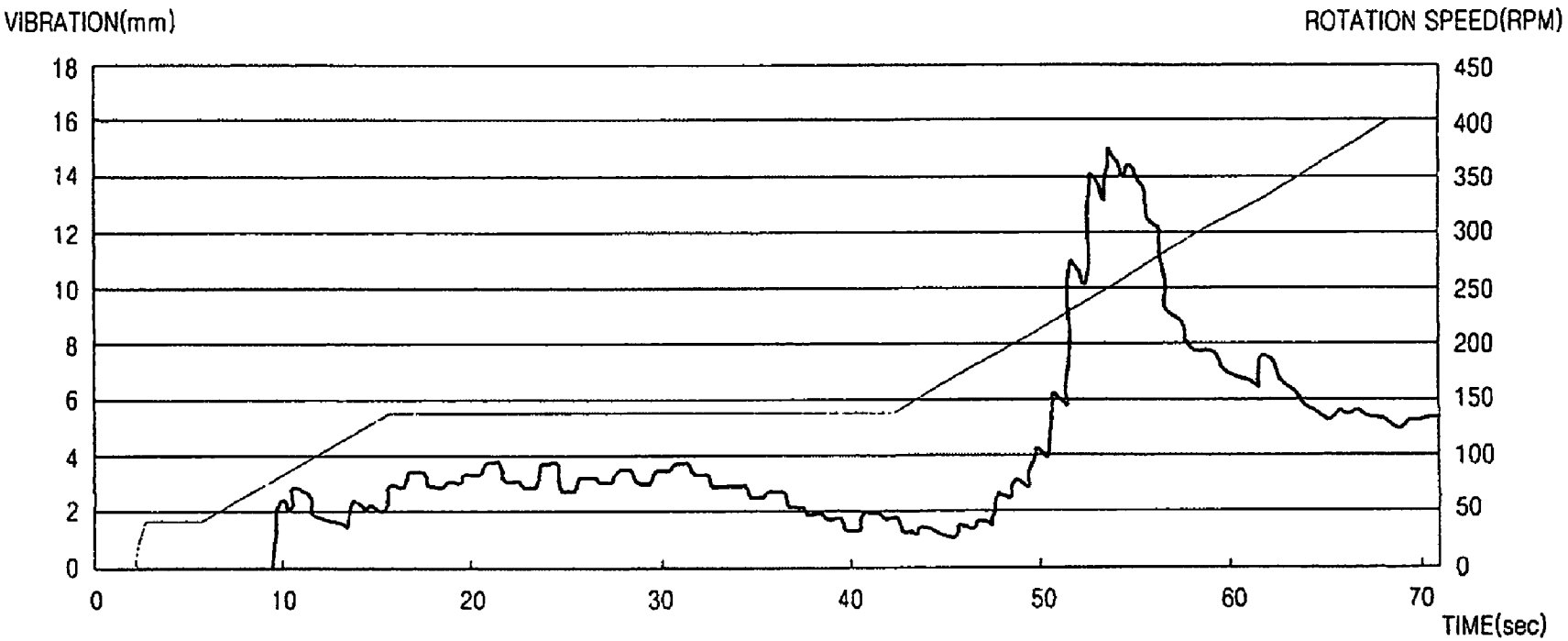
FIG. 11 is a graph showing a vibration value when the speed is increased at once in the excessive vibration period of the water tub.
Figure 12:
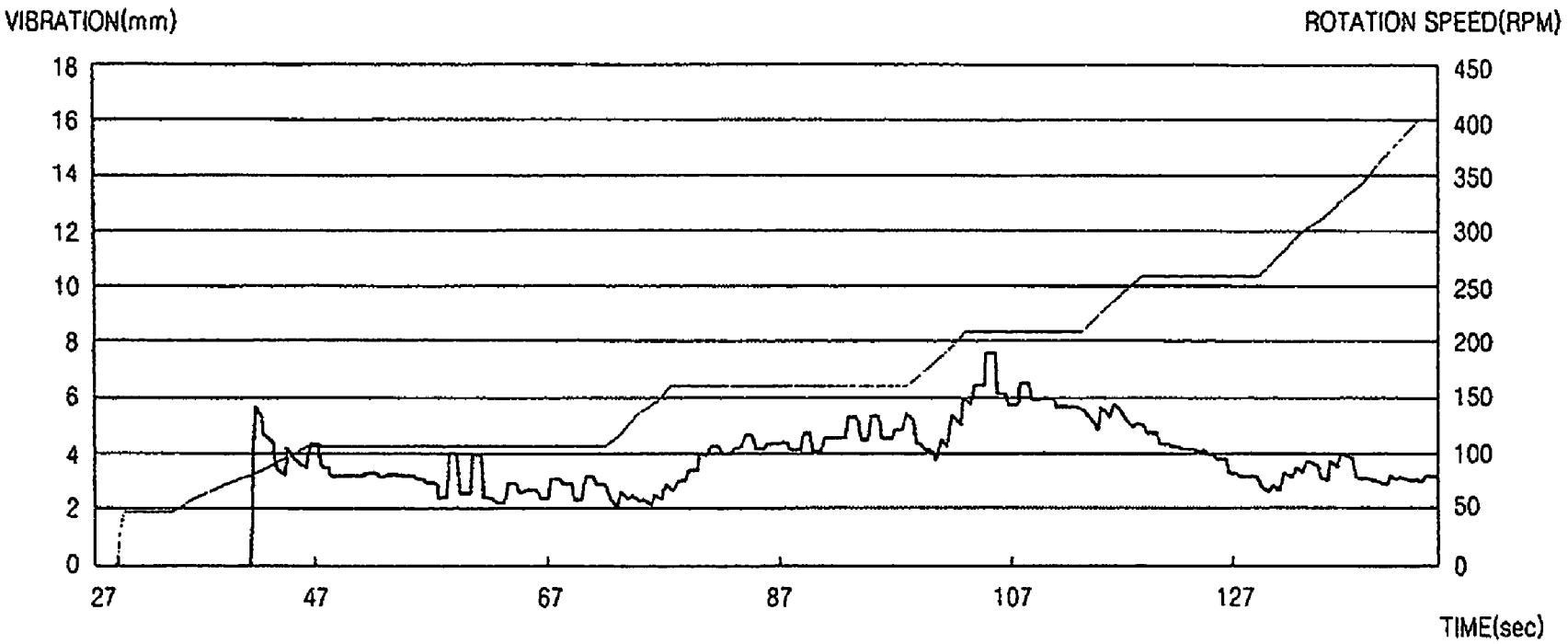
FIG. 12 is a graph showing a vibration value when the speed is increased stepwise in the excessive vibration period of the water tub.

FIG. 11 is a graph showing a vibration value (mm) when the speed of the rotation tub 30 is increased at once in the excessive vibration period of the water tub 20 and FIG. 12 is a graph showing a vibration value (mm) when the speed of the rotation tub 30 is increased stepwise in the excessive vibration period of the water tub 20.

As shown in FIGS. 11 and 12, it can be seen that a maximum vibration value is 15 mm when the speed of the rotation tub 30 is increased at once in the excessive vibration period of the water tub 20, but is 7.7 mm when the speed of the rotation tub 30 is increased stepwise in the excessive vibration period of the water tub 20.

Figure 13:
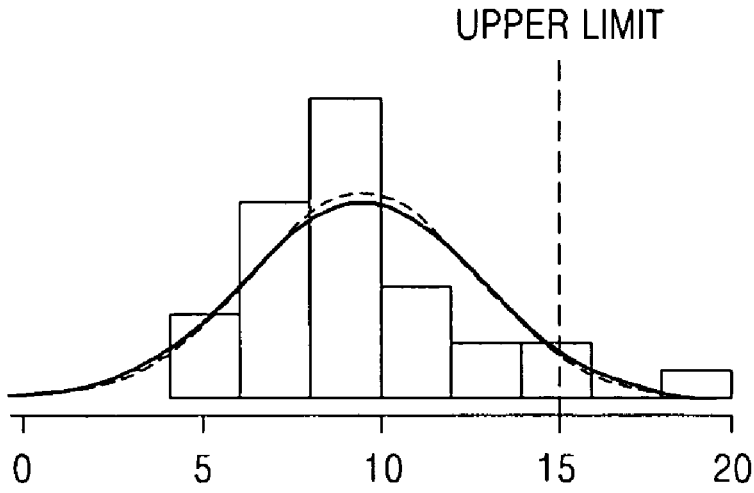
FIG. 13 is a graph showing a process capability obtained by repeatedly performing a vibration test in x and y axes 30 times and analyzing a maximum vibration value when the speed of the rotation tub is increased at once in the excessive vibration period of the water tub under a load condition of 80 percent of laundry.
Figure 13:
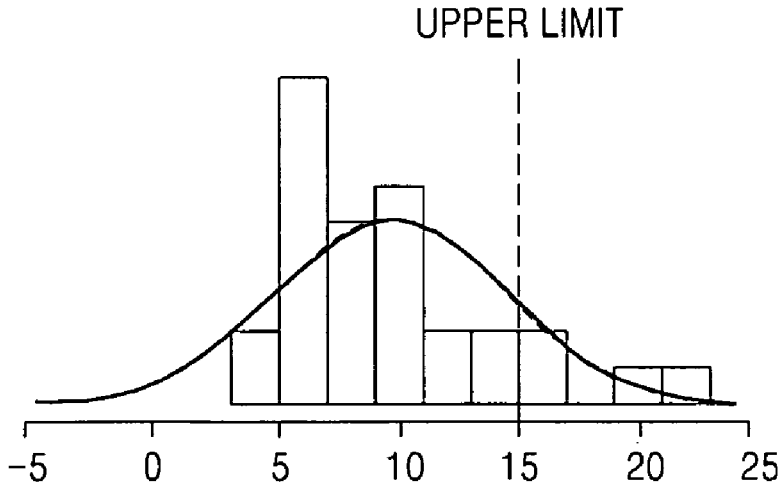
Figure 14:
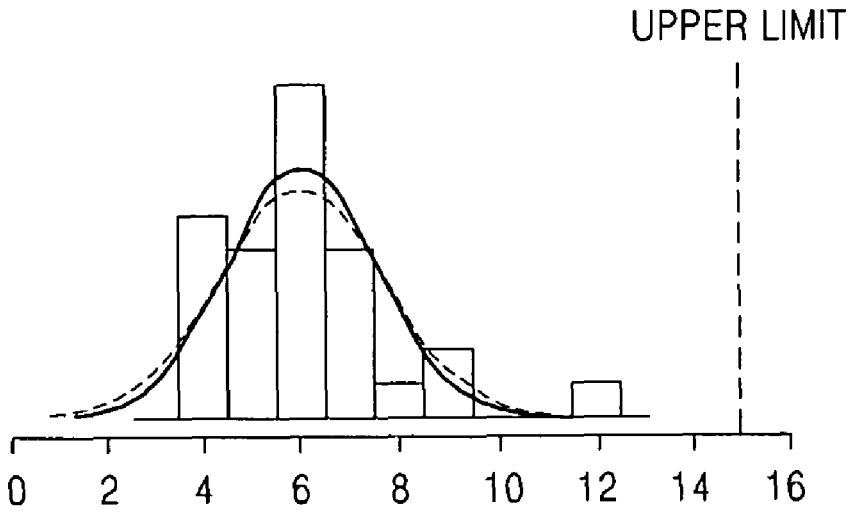
FIG. 14 is a graph showing a process capability obtained by repeatedly performing a vibration test in the x and y axes 30 times and analyzing a maximum vibration value when the speed of the rotation tub is increased stepwise in the excessive vibration period of the water tub under the load condition of 80 percent of laundry.
Figure 14:
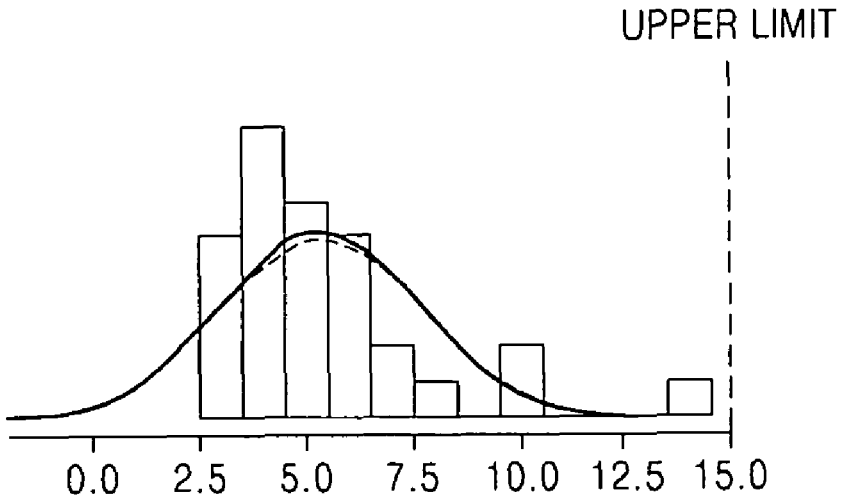

FIG. 13 is a graph showing a process capability obtained by repeatedly performing a vibration test in the x and y axes 30 times and analyzing the maximum vibration value when the speed of the rotation tub 30 is increased at once in the excessive vibration period of the water tub 20 under the load condition of 80 percent of laundry and FIG. 14 is a graph showing a process capability obtained by repeatedly performing a vibration test in the x and y axes 30 times and analyzing the maximum vibration value when the speed of the rotation tub 30 is increased stepwise in the excessive vibration period of the water tub 20 under the load condition of 80 percent of laundry. FIGS. 13A and 14A show the vibration in the x axis and FIGS. 13B and 14B show the vibration in the y axis.

As shown in FIGS. 13 and 14, it can be seen that an upper limit of the vibration when the speed of the rotation tub is increased stepwise is smaller than that of the vibration when the speed of the rotation tub is increased at once in the excessive vibration period of the water tub 20.

As described above, according to a washing machine and a method of controlling the same according to the present embodiment, since the speed of a rotation tub is increased in an excessive vibration period of a water tub in the washing machine including balancers, it is possible to pass the excessive vibration period of the water tub without the vibration.

In addition, since the unbalance state is detected in real time while the speed is increased stepwise and the speed is increased when the amount of unbalance is less than a restriction value, it is possible to prevent the rapid movement of balls and to remove the excessive vibration of the water tub with certainty.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A method of controlling a washing machine including a water tub, a rotation tub, and a ball balancer, the method comprising:

at a drying cycle, dividing a speed of the rotation tub stepwise in a period in which an excessive vibration of the water tub occurs due to an unbalance of the rotation tub;

increasing the speed of the rotation tub divided stepwise to reach a predetermined RPM and maintaining the speed of the rotation tub at the predetermined RPM during a predetermined amount of time such that a ball of the ball balancer is positioned opposite the unbalance of the rotation tub; and measuring an amount of time in which the speed of the rotation tub is maintained at the predetermined RPM, and when the measured amount of time exceeds the predetermined amount of time, increasing the speed of the rotation tub.

2. The method according to claim 1, further comprising calculating the predetermined RPM based on a speed of the rotation tub in which an unbalance is likely to occur.

3. The method according to claim 2, wherein the predetermined amount of time is an amount of time determined as necessary to remove the unbalance by the ball balancer at the predetermined RPM.

4. The method according to claim 1, wherein current of the motor is measured to detect an amount of unbalance while the speed of the rotation tub is increased stepwise, and the speed of the rotation tub is increased when the detected amount of unbalance is equal to or less than a predetermined restriction value.

5. The method according to claim 4, wherein the rotation tub is stopped when the amount of unbalance is greater than the restriction value.

* * * * *